US011125242B2

(12) United States Patent
Park et al.

(10) Patent No.: US 11,125,242 B2
(45) Date of Patent: Sep. 21, 2021

(54) COMPRESSOR SYSTEM AND METHOD OF CONTROLLING THE SAME

(71) Applicant: HANWHA POWER SYSTEMS CO., LTD., Changwon-si (KR)

(72) Inventors: Sungsoon Park, Changwon-si (KR); Joosang Eom, Changwon-si (KR)

(73) Assignee: HANWHA POWER SYSTEMS CO., LTD, Changwon-si (KR)

( * ) Notice: Subject to any disclaimer, the term of this patent is extended or adjusted under 35 U.S.C. 154(b) by 879 days.

(21) Appl. No.: 14/603,794

(22) Filed: Jan. 23, 2015

(65) Prior Publication Data

US 2015/0211518 A1 Jul. 30, 2015

(30) Foreign Application Priority Data

Jan. 24, 2014 (KR) ..... 10-2014-0009171

(51) Int. Cl.
*F04C 28/02* (2006.01)
*F04C 18/08* (2006.01)
(Continued)

(52) U.S. Cl.
CPC ..... *F04D 27/0269* (2013.01); *F04D 27/0246* (2013.01)

(58) Field of Classification Search
CPC ..... F04D 25/16; F04D 25/166; F04D 25/27; F04D 25/002; F04D 25/007;
(Continued)

(56) References Cited

U.S. PATENT DOCUMENTS 4,453,948 A * 6/1984 Fasching ..... C10J 3/22 137/110
4,560,319 A * 12/1985 Blotenberg ..... F04D 27/0253 415/1
(Continued)

FOREIGN PATENT DOCUMENTS

CN 101739686 A 6/2010
JP 2006-63813 A 3/2006

OTHER PUBLICATIONS

Mei Xiao et al., "Background Subtraction Algorithm Based on Online Clustering", Pattern Recognition and Artificial Intelligence, vol. 20, No. 1, Feb. 28, 2007. pp. 35-41.
(Continued)

*Primary Examiner* — Dominick L Plakkoottam
*Assistant Examiner* — Charles W Nichols
(74) *Attorney, Agent, or Firm* — Sughrue Mion, PLLC

(57) ABSTRACT

Provided is a compressor system including a first compressor having: an inlet at which a first inlet guide vane is provided; and an outlet pressure sensor unit configured to measure a pressure at an outlet of the first compressor; a second compressor including an inlet at which a second inlet guide vane is provided; a first control unit configured to adjust a degree of opening of the first inlet guide vane based on the pressure measured by the outlet pressure sensor unit, configured to set the outlet pressure of the first compressor as a set pressure, and configured to generate a first signal including information about the degree of opening of the first inlet guide vane; and a second control unit configured to receive the first signal, and configured to adjust a degree of opening of the second inlet guide vane to control an amount of fluid flowing into the second compressor.

8 Claims, 3 Drawing Sheets

(51) Int. Cl.
*F04C 23/00* (2006.01)
*F04C 28/24* (2006.01)
*F04D 27/02* (2006.01)

(58) Field of Classification Search
CPC ..... F04D 25/008; F04D 25/009; F04D 25/02; F04D 25/0207; F04D 25/0215; F04D 25/0246; F04D 25/0269
See application file for complete search history.

(56) References Cited

U.S. PATENT DOCUMENTS

| | | | | |
|---|---|---|---|---|
| 6,773,224 | B2 * | 8/2004 | Itou | F01D 17/04 415/1 |
| 2010/0178174 | A1 * | 7/2010 | Mehaffey | F04B 49/20 417/2 |
| 2011/0157392 | A1 | 6/2011 | Chou et al. | |

OTHER PUBLICATIONS

Communication dated Jun. 5, 2018, issued by the State Intellectual Property Office of P.R. China in counterpart Chinese application No. 201410425393.0.
Communication dated Jan. 28, 2020, issued by the Korean Intellectual Property Office in counterpart Korean Application No. 10-2014-0009171.

* cited by examiner

COMPRESSOR SYSTEM AND METHOD OF CONTROLLING THE SAME

CROSS-REFERENCE TO RELATED APPLICATION

This application claims priority from Korean Patent Application No. 10-2014-0009171, filed on Jan. 24, 2014, in the Korean Intellectual Property Office, the disclosure of which is incorporated herein by reference in its entirety.

BACKGROUND

1. Field

Apparatuses and methods consistent with exemplary embodiments relate to a compressor system and a method of controlling the same.

2. Description of the Related Art

As core equipment of a power plant, a compressor serves various functions (i.e., to pressurize and supply measuring gas, process gas, etc.). A plurality of compressors having the same function may be arranged and connected in parallel to simultaneously operate, thereby constituting a system of compressors. When the plurality of compressors are connected in parallel and operated, the number of operating compressors may be adjusted according to the amount of gas consumed in a power plant, and the operating compressors are controlled to evenly share a load so that the efficiency of a process and the life span of the plurality of compressors may be increased as much as possible.

In order to evenly distribute the load amongst the plurality of compressors, it is possible to increase the set pressure of a compressor having a lighter load, transfer a same flow amount command to the remaining compressors of the plurality of compressors, or uniformly maintain buffering distances between surge lines and operating points of the plurality of compressors.

However, according to the above method, the compressor system is stably operated only when a control gain of a controller is changed according to a change in the number of compressors connected in the overall system.

For example, while the system operates stably by using one compressor, if the load of the system increases and another compressor is additionally operated, the same effect as if the control gain had become double that of a normal state is achieved. Therefore, a transient response characteristic is degraded, and overshoot occurs, so that the pressure of the system may continuously fluctuate. On the other hand, if the number of operating compressors decreases while the system operates stably, the control gain of the controller also decreases. Therefore, the speed of achieving a control objective decreases, and a normal state error may occur. For this reason, when the load distribution method is used, a function of continuously receiving information about the number of operating compressors and adjusting the gain based on the information is additionally necessary.

In addition, according to the above load distribution method, a command for load equalization is generated when a load difference between individual compression periods is a specific value or more, and thus it is difficult for all the compressors to maintain the same load at all times.

An apparatus and method for controlling the operation of a gas turbine having general compressors as described above are disclosed in detail in Korean Patent Publication No. 2010-0043065.

SUMMARY

One or more exemplary embodiments provide a compressor system for evenly distributing a load by causing inlet guide vanes to have a same degree of opening, and a method of controlling the compressor system.

Additional aspects will be set forth in part in the description which follows and, in part, will be apparent from the description, or may be learned by practice of the presented exemplary embodiments.

According to an aspect of an exemplary embodiments, there is provided a compressor system including: a first compressor having: an inlet at which a first inlet guide vane is provided; and an outlet pressure sensor unit configured to measure a pressure at an outlet of the first compressor; a second compressor including an inlet at which a second inlet guide vane is provided; a first control unit configured to adjust a degree of opening of the first inlet guide vane based on the pressure measured by the outlet pressure sensor unit, configured to set the outlet pressure of the first compressor as a set pressure, and configured to generate a first signal including information about the degree of opening of the first inlet guide vane; and a second control unit configured to receive the first signal, and configured to adjust a degree of opening of the second inlet guide vane to control an amount of fluid flowing into the second compressor.

The first control unit and the second control unit may control the first inlet guide vane and the second inlet guide vane respectively so that the degree of opening of the first inlet guide vane and the degree of opening of the second inlet guide vane are equal.

The first control unit and the second control unit may control the first inlet guide vane and the second inlet guide vane respectively so that the pressure at the outlet of the first compressor and a pressure at the outlet of the second compressor are equal.

The compressor system may further include a filter unit configured to receive the first signal from the first control unit, configured to remove noise from the first signal, and configured to transfer the first signal to the second control unit.

The second compressor may include a plurality of the second compressors, and the plurality of second compressors are connected in parallel with the first compressor.

The compressor system may further include: a first guide flow path connected to the outlet of the first compressor and configured to guide the fluid compressed by the first compressor to an exterior of the compressor system; a second guide flow path connected to the outlet of the second compressor and configured to the fluid compressed by the second compressor to the exterior of the compressor system; a third guide flow path connected to the first guide flow path and the second guide flow path and configured to the fluid to the exterior of the compressor system; a vent flow path branched off from at least one selected from a group consisting of the first guide flow path and the second guide flow path and configured to guide the fluid to the outside; and a surge valve unit provided on the vent flow path and configured to selectively open and close the vent flow path.

The second compressor may be provided in parallel with the first compressor.

The compressor system may further include: a first anti-surge valve unit connected to the first compressor and configured to adjust a point in time of surging of the first compressor or configured to reduce a number of occurrences of surging of the first compressor; and a second anti-surge valve unit connected to the second compressor and configured to adjust a point in time of surging of the second compressor or configured to reduce a number of occurrences of surging of the second compressor According to an aspect of another exemplary embodiments, there is provided a method of controlling a compressor system including: measuring an outlet pressure of a first compressor; comparing the outlet pressure of the first compressor with a set pressure; controlling a degree of opening of a first inlet guide vane and setting the outlet pressure of the first compressor as the set pressure; converting information about the degree of opening of the first inlet guide vane into a first signal; passing the first signal through a low pass filter, filtering the first signal to remove noise, and sending the filtered first signal to a second control unit; sending a second signal corresponding to the first signal to a second inlet guide vane installed at an inlet of a second compressor; and setting a degree of opening of the second inlet guide vane to be equal to the degree of opening of a first inlet guide.

The method may further include setting the outlet pressure of the first compressor and a pressure at an outlet pressure of the second compressor to be equal.

The method may further include: providing a first anti-surge valve unit connected to the first compressor to adjust a point in time of surging of the first compressor or to reduce a number of occurrences of surging of the first compressor; and providing a second anti-surge valve unit connected to the second compressor unit to adjust a point in time of surging of the second compressor or to reduce a number of occurrences of surging of the second compressor.

The setting the degree of opening of the second inlet guide vane may include setting the degree of opening of the second inlet guide vane after the setting the outlet pressure of the first compressor as the set pressure.

BRIEF DESCRIPTION OF THE DRAWINGS

The above and/or other aspects will become apparent and more readily appreciated from the following description of exemplary embodiments, taken in conjunction with the accompanying drawings in which.

DETAILED DESCRIPTION

Figure 1:
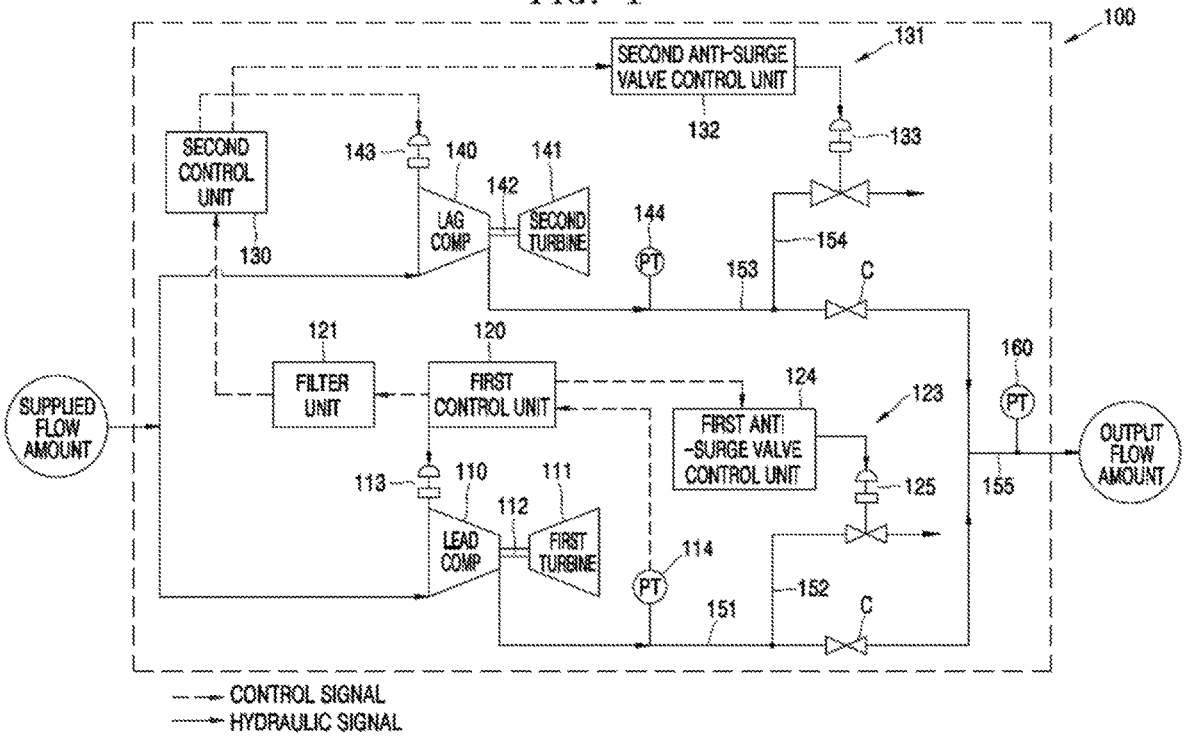
FIG. 1 is the conceptual diagram of a compressor system according to an exemplary embodiment.

Reference will now be made in detail to exemplary embodiments, examples of which are illustrated in the accompanying drawings, wherein like reference numerals refer to like elements throughout. In this regard, the exemplary embodiments may have different forms and should not be construed as being limited to the descriptions set forth herein. Accordingly, the exemplary embodiments are merely described below, by referring to the figures, to explain aspects of the present description. The inventive concept is only defined by the claims. Meanwhile, the terminology used in this application is used to describe exemplary embodiments and is not intended to limit the inventive concept. In this application, an expression in the singular includes an expression in the plural unless otherwise stated. As used herein, the terms "comprises", "includes", and "has" and/or "comprising", "including", and "having" indicate the existence of components, steps, operations, and/or elements mentioned herein without excluding in advance the possibility of existence or addition of one or more other components, steps, operations, and/or elements. The terms "first", "second", etc. can be used to describe various elements, but these elements are not limited by the terms. The terms are only used to distinguish one element from other elements.

Figure 2:
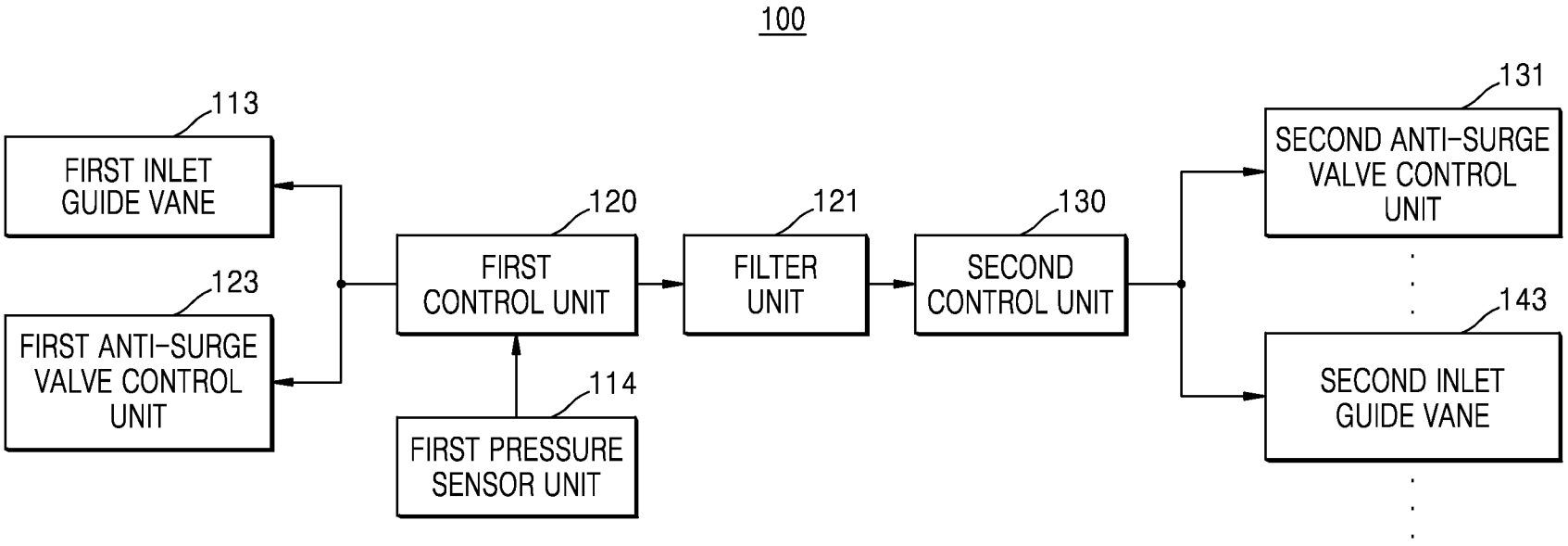
FIG. 2 is a block diagram showing a control flow of the compressor system shown in FIG. 1 according to an exemplary embodiment.

FIG. 1 is the conceptual diagram of a compressor system according to an exemplary embodiment, and FIG. 2 is a block diagram showing a control flow of the compressor system shown in FIG. 1 according to an exemplary embodiment.

Referring to FIGS. 1 and 2, a compressor system 100 may include a lead compressor 110, a first inlet guide vane 113, a first control unit 120, a filter unit 121, a first anti-surge valve unit 123, a second control unit 130, a second anti-surge valve unit 131, a lag compressor 140, a second inlet guide vane 143, a first guide flow path 151, a first vent flow path 152, a second guide flow path 153, and a second vent flow path 154.

The lead compressor 110 may set an amount of load to be shared in order to share the load amount with the lag compressor 140. Also, the lead compressor 110 may compare a previously set pressure with a pressure obtained during an actual operation to compare the previously set load with an actual load. The lead compressor 110 is connected to a first drive unit 111 through a first rotation axis 112 and receives a turning force from the first drive unit 111. As the lead compressor 110, any well-known compressor of the related art may be used, and thus, the structure and the operation principle of the lead compressor 110 will not be described in detail herein.

At the inlet of the lead compressor 110, the first inlet guide vane 113 is installed and may control the amount of fluid flowing into the lead compressor 110. At the outlet of the lead compressor 110, a first pressure sensor unit 114 is installed and may measure the pressure of the fluid at the outlet of the lead compressor 110.

The outlet of the lead compressor 110 is connected to the first guide flow path 151 and may guide the fluid compressed by the lead compressor 110 to the outside of the compressor system 100. The first pressure sensor unit 114 is installed on the first guide flow path 151, and the installation space of the first pressure sensor unit 114 is reduced as much as possible, so that the first pressure sensor 114 may be compactly installed within the compressor system 100. Also, the first vent flow path 152 is formed on the first guide flow path 151, so that the first anti-surge valve unit 123 may be installed.

The first anti-surge valve unit 123 may have a first anti-surge valve 125 and a first anti-surge valve control unit 124. The first anti-surge valve 125 may open and close to prevent surging in the lead compressor 110.

When surging occurs in the lead compressor 110, the first anti-surge valve unit 123 opens the first anti-surge valve 125 to adjust a point in time of surging or reduce the number of occurrences of surging as much as possible. Also, the first anti-surge valve unit 123 may set a pressure at which the occurrence of surging is expected, and open the first anti-surge valve 125 at the set pressure to prevent the occurrence of surging.

The first anti-surge valve control unit 124 may determine whether or not surging has occurred in the lead compressor 110 based on a signal. Also, the first anti-surge valve control unit 124 may send a signal for opening and closing the first anti-surge valve 125 to control the first anti-surge valve 125. The anti-surge valve control unit 124 may be connected to the first control unit 120, which will be described below, and control the first anti-surge valve 125 by using the pressure signal of the outlet of the lead compressor 110 sent from the first pressure sensor unit 114. Alternatively, the first anti-surge valve control unit 124 may have a surging-check sensor unit (not shown) to determine whether or not surging has occurred in the lead compressor, thereby controlling the first anti-surge valve 125 independently. However, for convenience of description, the following description will be given focusing on the case where the first anti-surge valve control unit 124 is connected to the first control unit 120 and controls the first anti-surge valve 125.

The first control unit 120 may be connected to the first inlet guide vane 113, the first pressure sensor unit 114, the filter unit 121, and the first anti-surge valve control unit 124 via a control signal. Here, the first control unit 120 may take various forms, and may control all components of the compressor system 100 in addition to the first inlet guide vane 113, the first pressure sensor unit 114, the filter unit 121, and the first anti-surge valve control unit 124. In particular, the first control unit 120 may be formed in various manners, such as a portable terminal, a personal computer (PC), and a laptop computer.

The first pressure sensor unit 114 measures a pressure at the outlet of the lead compressor 110, and the first control unit 120 may receive a signal indicating the outlet pressure of the lead compressor 110. The first control unit 120 may compare the received output pressure with the pressure at the outlet of the lead compressor 110 set by the user and send a signal for adjusting the degree of opening of the first inlet guide vane 113 (hereinafter referred to as an adjustment signal) to the first inlet guide vane 113. Also, the first control unit 120 may send a signal indicating the degree of opening of the first inlet guide vane 113 (hereinafter referred to as a first signal) to the filter unit 121.

The first control unit 120 may send a signal for controlling the first anti-surge valve control unit 124 to the first anti-surge valve control unit 124, so that the first anti-surge valve 125 may open and reduce the occurrence of surging. Also, the first control unit 120 may adjust the degree of opening of the first inlet guide vane 113 to adjust the outlet pressure of the lead compressor 110, thereby reducing the occurrence of surging.

In order to selectively send the first signal to the second control unit 130, a low pass filter may be used as the filter unit 121. In other words, when the first signal has a specific frequency or less, the first signal passes through the filter unit 121 and arrives at the second control unit 130. On the other hand, when the first signal has a higher frequency than the specific frequency, the first signal is blocked. Therefore, noise resulting from a drastic change in load is removed, so that the stability of the system may be ensured.

The second control unit 130 may be connected to the second inlet guide vane 143, the second anti-surge valve unit 131, and the filter unit 121 with a control signal. Here, the second control unit 130 may take various forms, and may control all components of the compressor system 100 in addition to the second inlet guide vane 143, the second anti-surge valve unit 131, and the filter unit 121. In particular, such a second control unit 130 may be formed in various manners, such as a portable terminal, a PC, and a laptop computer as discussed previously regarding the first control unit 120.

The second control unit 130 receives the first signal from the filter unit 121. Also the second control unit 130 sends a second signal corresponding to the first signal to the second inlet guide vane 143. The second signal causes the degree of opening of the second inlet guide vane 143 to be the same as the degree of opening of the first inlet guide vane 113. In other words, by adjusting the degree of opening of the second inlet guide vane 143, the second control unit 130 may cause the outlet pressure of the lag compressor 140 to be the same as the outlet pressure of the lead compressor 110. When there is a plurality of the lag compressors 140, the second control unit 130 may control the outlet pressures of the plurality of lag compressors 140 by sending the second signal to the respective inlet guide vanes 143 of the plurality of lag compressors 140.

Also, the second control unit 130 may send a signal for controlling the second anti-surge valve control unit 132 to the second anti-surge valve control unit 132. At this time, the second control unit 130 may adjust the degree of opening of the second inlet guide vane 143 to adjust the outlet pressure of the lag compressor 140.

The second control unit 130 adjusts the degree of opening of the second inlet guide vane 143 to share a load with the lead compressor 110. There may be a plurality of the lag compressors 140, and the plurality of lag compressors 140 may be connected in parallel with the lead compressor 110. The lag compressor 140 is connected to a second drive unit 141 through a second rotation axis 142 and receives a turning force from the second drive unit 141. Since the structure and the operation of the lag compressor 140 are similar to those of the lead compressor 110, their description will be omitted or only briefly given here.

At the inlet of the lag compressor 140, the second inlet guide vane 143 is installed and may control the amount of fluid flowing into the lag compressor 110. At the outlet of the lag compressor 140, a second pressure sensor unit 144 is installed and may measure the pressure of the fluid at the outlet of the lag compressor 140.

The outlet of the lag compressor 140 is connected to the second guide flow path 153 and may guide the fluid compressed by the lag compressor 140 to the outside of the compressor system 100. The second pressure sensor unit 144 is installed on the first guide flow path 153, and the installation space of the second pressure sensor unit 144 is reduced as much as possible, so that the second pressure sensor 144 may be compactly installed. Also, the second vent flow path 154 is formed on the second guide flow path 153, so that the second anti-surge valve unit 131 may be installed.

The first guide flow path 151 and the second guide flow path 153 together constitute a third guide flow path 155 to discharge the fluid passed through the lead compressor 110 and the lag compressor 140 to the outside. In addition, a third pressure sensor unit 160 is installed on the third guide flow path 155 and may check the pressure of the compressed fluid.

Figure 3:
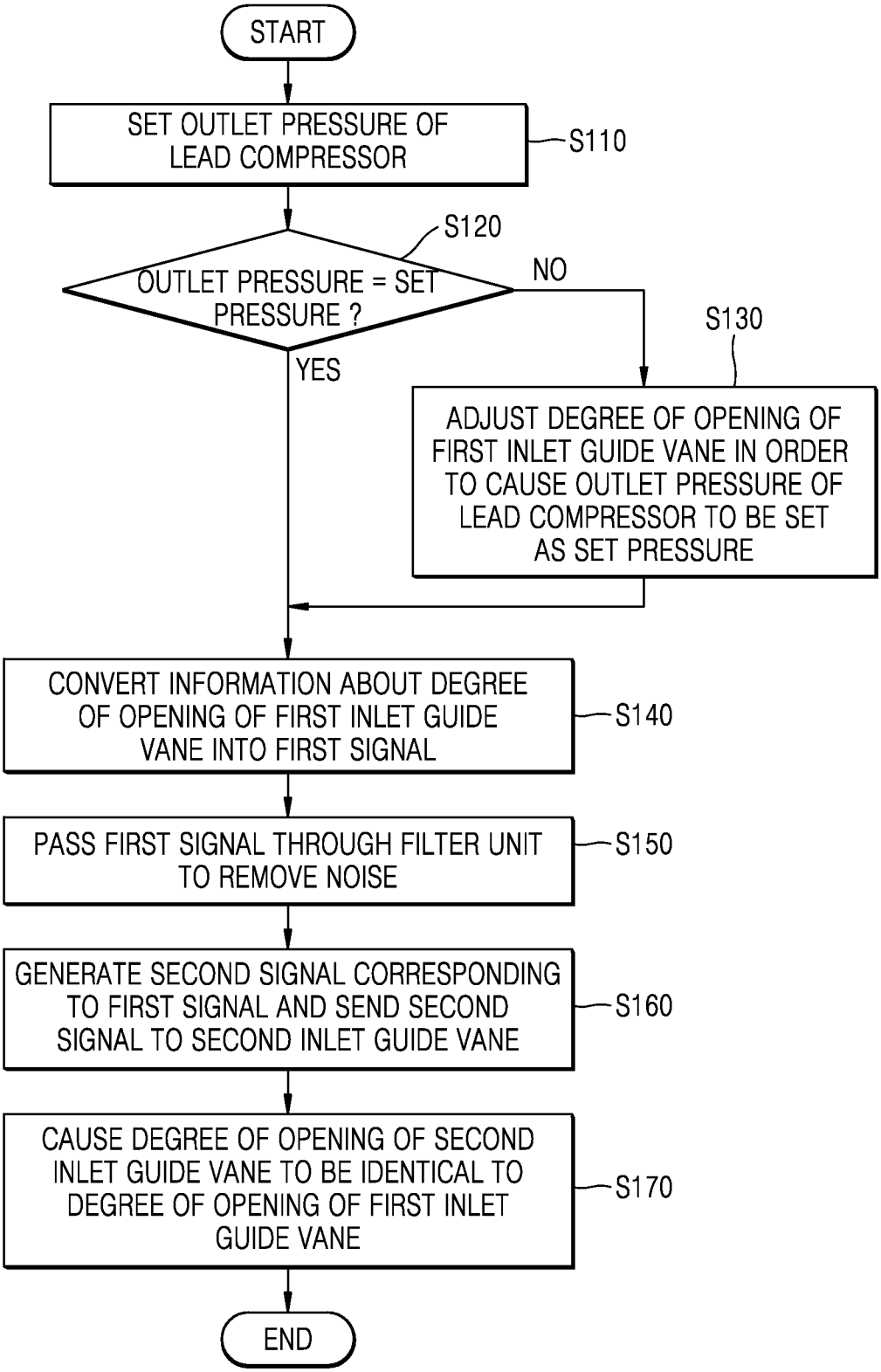
FIG. 3 is a flowchart illustrating a control sequence of the compressor system shown in FIG. 1 according to an exemplary embodiment.

FIG. 3 is a flowchart illustrating a control sequence of the compressor system shown in FIG. 1 according to an exemplary embodiment.

A method of sharing a load between the lead compressor 110 and the lag compressor (or the plurality of lag compressors)140 will be described with reference to FIG. 3.

For load sharing, a pressure at each of the outlets of the lead compressor 110 and the lag compressor 140 is set. More specifically, pressures of the lead compressor 110 and the lag compressor may be set so that the fluid has the same pressure at the respective outlets and the lead compressor 110 and the lag compressor 140 have the same load. The first pressure sensor unit 114 at the outlet of the lead compressor 110 checks the outlet pressure of the lead compressor 110 and sends an outlet pressure signal to the first control unit 120 (operation S110).

The first control unit 120 determines whether or not the outlet pressure of the lead compressor 110 is the same as the previously set pressures (operation S120).

When the outlet pressure of the lead compressor 110 differs from the corresponding set pressure, the degree of opening of the first inlet guide vane 113 is adjusted so that the outlet pressure of the lead compressor 110 becomes the same as the corresponding set pressure. In other words, the first control unit 120 sends an adjustment signal to the first inlet guide vane 113 and adjusts the degree of opening of the first inlet guide vane 113 to change the flow amount of fluid, thereby causing the outlet pressure of the lead compressor 110 to be the same as the corresponding set pressure (operation S130).

At this time, the first control unit 120 converts information about the degree of opening of the first inlet guide vane 113 into a first signal. The first signal causes the degree of opening of the second inlet guide vane 143 and the degree of opening of the first inlet guide vane 113 to be the same so that the lag compressor 140 and the lead compressor 110 evenly share the load (operation S140).

The first control unit 120 sends the first signal to the filter unit 121. The filter unit 121 may maintain the stability of the compressor system 100 by removing noise from the first signal. The filter unit 121 removes fluctuations of the first signal, and the first signal is selectively sent, so that the stability of the system 100 may be improved (operation S150).

The second control unit 130 may receive the first signal passed through the filter unit 121, generate a second signal corresponding to the first signal, and send the second signal to the second inlet guide vane 143. The second signal causes the second inlet guide vane 143 to have the same degree of opening as the first inlet guide vane 113 (operation S160).

The second inlet guide vane 143 having received the second signal has the same degree of opening as the first inlet guide vane 113. When the degree of opening of the first inlet guide vane 113 and the degree of opening of the second inlet guide vane 143 are identical, the amount of the fluid flowing into the lead compressor 110 and the amount of the fluid flowing into the lag compressor 140 are identical, and the outlet pressures of the respective compressors become identical. In other words, the pressure of the fluid measured by the first pressure sensor unit 114 and the pressure of the fluid measured by the second pressure sensor unit 144 may become identical (operation S170).

In the compressor system 100, the inlet guide vane of the lead compressor 110 and the inlet guide vane of the lag compressor 140 are controlled to have the same degree of opening, and a load is evenly distributed, so that the stability of the system 100 may be ensured. In other words, the respective compressors are controlled to have the same output pressure, and the load of the compressor system 100 is evenly distributed, that is, the load is not concentrated on a specific compressor, so that the compressor system 100 may stably operate.

In addition, in the compressor system 100, a control signal may pass through the filter unit 121 so that noise may be removed. Therefore, it is possible to prevent excessive changes in pressure and load that may be caused when a plurality of inlet guide vanes simultaneously operate, so that the stability of the system 100 may be ensured.

Further, in the compressor system 100, even when communication is cut off from the outside, the degree of opening of the inlet guide vane of each compressor is maintained as it is, and no drastic change in process is caused. Also, regardless of a change in the number of operating compressors, it is possible to exhibit control performance at the same level as input control of the lead compressor 110. Consequently, high reliability may be ensured.

Moreover, in the compressor system 100, an anti-surge valve unit is prepared for each compressor, and it is possible to perform a surge prevention operation and immediately perform a surge avoidance operation upon the occurrence of surging.

As described above, according to the one or more of the above exemplary embodiments, the inlet guide vanes of a lead compressor and a lag compressor have the same degree of opening to evenly distribute a load, so that the stability of a compressor system may be ensured.

In addition, a filter unit is prepared to prevent excessive changes in pressure and load, so that the compressor system may be stably operated. The scope of the inventive concept is not limited to these effects.

It should be understood that the exemplary embodiments described herein should be considered in a descriptive sense only and not for purposes of limitation. Descriptions of features or aspects within each exemplary embodiment should typically be considered as available for other similar features or aspects in other exemplary embodiments.

While exemplary embodiments have been described with above, it will be understood by those of ordinary skill in the art that various changes in form and details may be made therein without departing from the spirit and scope of the inventive concept as defined by the following claims.

What is claimed is:

1. A compressor system comprising:

a first compressor comprising:

an inlet at which a first inlet guide vane is provided; and an outlet pressure sensor unit configured to measure a pressure at an outlet of the first compressor;

a second compressor comprising an inlet at which a second inlet guide vane is provided;

a third compressor comprising an inlet at which a third inlet guide vane is provided;

a first control unit configured to adjust a degree of opening of the first inlet guide vane based on the pressure measured by the outlet pressure sensor unit, configured to compare the outlet pressure of the first compressor with a set pressure to set the outlet pressure of the first compressor as the set pressure, and configured to generate a first signal including information about the degree of opening of the first inlet guide vane, the set pressure being less than the maximum operational pressure of the first compressor;

a second control unit configured to receive the first signal, and configured to send a second signal, corresponding to the first signal, to the second inlet guide vane and the third inlet guide vane so as to adjust a degree of opening of the second inlet guide vane to control an amount of fluid flowing into the second compressor and to adjust a degree of opening of the third inlet guide vane to control an amount of fluid flowing into the third compressor, respectively;

a first anti-surge valve unit connected to the first compressor and configured to adjust a point in time of surging of the first compressor or configured to reduce a number of occurrences of surging of the first compressor; and a second anti-surge valve unit connected to the second compressor and configured to adjust a point in time of surging of the second compressor or configured to reduce a number of occurrences of surging of the second compressor, a third anti-surge valve unit connected to the third compressor and configured to adjust a point in time of surging of the third compressor or configured to reduce a number of occurrences of surging of the third compressor, wherein the second control unit is configured to adjust the degree of opening of the second inlet guide vane after the first control unit adjusts the degree of opening of the first inlet guide vane to set the outlet pressure of the first compressor as the set pressure, wherein based on the pressure measured by the outlet pressure sensor unit, the first, second, and third inlet guide vanes and the first, second, and third anti-surge valve units are controlled, wherein the degree of opening of the first inlet guide vane, the degree of opening of the second inlet guide vane, and the degree of opening of the third inlet guide vane are controlled to be equal, and wherein, based on the outlet pressure of the first compressor, an opening degree of the first anti-surge valve unit, an opening degree of the second anti-surge valve unit, and an opening degree of the third anti-surge valve unit are controlled to be equal.

2. The compressor system of claim 1, wherein the first control unit and the second control unit control the first inlet guide vane and the second inlet guide vane respectively so that the pressure at the outlet of the first compressor and a pressure at the outlet of the second compressor are equal.

3. The compressor system of claim 1, further comprising a filter unit configured to receive the first signal from the first control unit, configured to remove noise from the first signal, and configured to transfer the first signal to the second control unit.

4. The compressor system of claim 1, wherein the second compressor and the third compressor are connected in parallel with the first compressor.

5. The compressor system of claim 1 further comprising:

a first guide flow path connected to the outlet of the first compressor and configured to guide the fluid compressed by the first compressor to an exterior of the compressor system;

a second guide flow path connected to the outlet of the second compressor and configured to the fluid compressed by the second compressor to the exterior of the compressor system;

a third guide flow path connected to the first guide flow path and the second guide flow path and configured to guide the fluid to the exterior of the compressor system;

a vent flow path branched off from at least one selected from a group consisting of the first guide flow path and the second guide flow path and configured to guide the fluid to the outside; and a surge valve unit provided on the vent flow path and configured to selectively open and close the vent flow path.

6. The compressor system of claim 1, wherein the second compressor is provided in parallel with the first compressor.

7. A method of controlling a compressor system, the method comprising:

measuring an outlet pressure of a first compressor;

comparing the outlet pressure of the first compressor with a set pressure, the set pressure being less than the maximum operational pressure of the first compressor;

controlling a degree of opening of a first inlet guide vane and setting the outlet pressure of the first compressor as the set pressure;

converting information about the degree of opening of the first inlet guide vane into a first signal;

passing the first signal through a low pass filter, filtering the first signal to remove noise, and sending the filtered first signal to a second control unit;

sending, with the second control unit, a second signal corresponding to the first signal to a second inlet guide vane installed at an inlet of a second compressor and to a third inlet guide vane installed at an inlet of a third compressor;

setting a degree of opening of the second inlet guide vane to be equal to the degree of opening of a first inlet guide after the degree of opening of the first inlet guide vane is adjusted to be the set pressure;

providing a first anti-surge valve unit connected to the first compressor to adjust a point in time of surging of the first compressor or to reduce a number of occurrences of surging of the first compressor;

providing a second anti-surge valve unit connected to the second compressor to adjust a point in time of surging of the second compressor or to reduce a number of occurrences of surging of the second compressor;

providing a third anti-surge valve unit connected to the third compressor and configured to adjust a point in time of surging of the third compressor or configured to reduce a number of occurrences of surging of the third compressor; and controlling the first, second, and third inlet guide vanes and the first, second, and third anti-surge valve units based on the measured outlet pressure of the first compressor, wherein the degree of opening of the second inlet guide vane and a degree of opening of the third inlet guide vane is following the degree of opening of the first inlet guide vane to be equal.

8. The method of claim 7 further comprising setting the outlet pressure of the first compressor and a pressure at an outlet pressure of the second compressor to be equal.

* * * * *